United States Patent [19]

Charrier et al.

[11] 4,366,778

[45] Jan. 4, 1983

[54] GAS BOILER ABLE TO OPERATE IN A SEALED COMBUSTION CIRCUIT

[75] Inventors: Elie Charrier, Boulogne; René Fourno, Paris, both of France

[73] Assignee: Paquet Thermique, S.A., Beaumont S/Oise, France

[21] Appl. No.: 247,929

[22] Filed: Mar. 26, 1981

[30] Foreign Application Priority Data

Mar. 27, 1980 [FR] France ..... 80 06823
Oct. 31, 1980 [FR] France ..... 80 23325

[51] Int. Cl.[3] ..... F22B 9/02; F22B 21/00
[52] U.S. Cl. ..... 122/17; 122/367 C
[58] Field of Search ..... 122/17, 18, 13 R, 14, 122/367 A, 367 C

[56] References Cited

U.S. PATENT DOCUMENTS

| | | | |
|---|---|---|---|
| 3,091,223 | 5/1963 | Vitale | 122/17 |
| 3,320,935 | 5/1967 | McCorquodale | 122/494 |
| 3,701,340 | 10/1972 | Miller | 122/367 C |
| 3,707,142 | 12/1972 | Kobayashi | 122/17 |
| 4,055,152 | 10/1977 | Vidalenq | 122/367 C |

FOREIGN PATENT DOCUMENTS

| | | | |
|---|---|---|---|
| 2100344 | of 0000 | Fed. Rep. of Germany . | |
| 2162139 | of 0000 | Fed. Rep. of Germany . | |
| 2604784 | of 0000 | Fed. Rep. of Germany . | |
| 2096022 | of 0000 | France . | |
| 2314448 | of 0000 | France . | |
| 1324636 | of 0000 | United Kingdom . | |
| 2025586 | 1/1980 | United Kingdom | 122/17 |

*Primary Examiner*—Henry C. Yuen
*Attorney, Agent, or Firm*—Cushman, Darby & Cushman

[57] ABSTRACT

This boiler is enclosed in a sealed casing forming a fore-heath which surrounds it on all sides while providing thereabout a space into which the combustion air arrives.

The combustion air is injected under pressure into a space which surrounds the boiler and an exchanger is divided into two parts in the vertical direction by a refractory floor in one embodiment, which enables it to function as an exchanger in the upper part and in the lower part, cold water is received where the exchanger functions as an exchanger and a condenser; the burner may have features to reduce the pressure drop of the combustion air flow and to permit ease of assembly and disassembly.

10 Claims, 10 Drawing Figures

GAS BOILER ABLE TO OPERATE IN A SEALED COMBUSTION CIRCUIT

BACKGROUND OF THE INVENTION

There exists on the market so-called "air vent" gas boilers with sealed combustion circuit.

These boilers are in general placed against a wall and raised up. Their power does not, in practice, exceed 70 kW for, above this value, there exists no boiler/burner combination to satisfy the problem of "vent hole" operation.

SUMMARY OF THE INVENTION

The present invention has as its principal objective the provision of a compact and low-priced boiler, which can be operated in a sealed combustion circuit with powers appreciably greater than those of known vent-hole boilers.

To this end, the boiler, closed in a sealed casing forming a fore-hearth, which surrounds it on all sides while providing thereabout a space in which the combustion air arrives is essentially characterized in that said combustion air is injected under pressure into the space which surrounds the boiler.

When this air is taken from the outside, the boiler operates in a sealed combustion circuit, the air-intake ducts and the burnt-gas exhaust ducts being able to be situated close to one another so that the possible wind has no influence on the combustion air flow.

Fresh air may also be sucked into the boiler room, the duct for discharging the combustion products then being connected to a chimney.

The "pressurized" fore-hearth which surrounds the boiler on all sides prevents any leakage of the combustion products from spreading into the boiler room.

It serves as a very efficient heat insulator allowing a very low temperature of the outer walls of the casing to be obtained and protects from the heat the safety and control apparatus which are housed therein.

Advantageously, the casing is disposed vertically and provided with a removable cover at its upper part, the boiler comprising a box containing an exchanger and one or more vertically disposed burners so that the air-gas mixture of these burners flows from top to bottom, the fresh air and the gas being injected at the upper part. Thus, not only is the maintenance of the burner easy, but there occurs natural circulation of the injected air which ensures cooling of the boiler without requiring excess power of the fan and with preheating of the air supplied to the burner, so recovery of heat increasing the overall efficiency of the boiler.

The exchanger is formed preferably from vertical-finned tubes disposed around the burner(s) or on each side thereof, these tubes being connected at their ends to water inlet and outlet manifolds. Thus high power is obtained in a compact apparatus.

This exchanger may be combined with a tube for supplying hot water for sanitary or industrial purposes for example. The burner(s) are fed with air and gas in substantially stoechiometric proportions. They comprise advantageously a tubular body having holes over the whole of its height facing the tubes of the exchanger, the distribution of the heat flow being provided by partial and suitable closure of the holes.

The boiler is particularly suitable for supplying heating installations combined with a hot-water supply service or not.

In accordance with a particular embodiment of the boiler of the invention, its exchanger is divided into two parts in the vertical direction by a refractory floor, which allows it to play, in the part which is situated above this floor and which contains the burner(s), its conventional role as an exchanger, and in the part which is situated below the floor, and where it receives cold water, both a role as an exchanger and a role as a condenser of the combustion products.

This configuration of the exchanger further improves the efficiency of the boiler of the invention.

Indeed no one is ignorant of the fact that the efficiency of boilers is a determining element in the field of energy economy.

The boilers constructed at present have their efficiency pushed practically to their extreme limit. The only reason which prevents a truly maximum efficiency being reached is that the combustion products carry away heat to the outside because of their temperature. These combustion products are nitrogen, $CO_2$ and especially water vapor whose weight is relatively considerable; 1.611 kg per $m^3$ of natural gas burnt according to the reaction diagram below:

$$CH_4+2O_2\ (+N)\rightarrow CO_2+2H_2O\ (+N)+214\ \text{kcal}\ (895.690\ \text{kJ}),$$

214 kcal being the exothermic heat.

It is then important to be able to recover the greatest possible part of the heat carried off by the combustion gases and the greatest part of the water vapor whose condensation allows 516 cal/kg (2159.710 J)—latent vaporization heat—to be recovered.

To reach this result, it is sufficient to cause the burnt gases mixed with the water vapor to pass through an exchanger placed at the outlet of the boiler.

This may be formed from smooth or finned tubes in which flows the return water from the radiators. The condensation phenomenon begins as soon as the temperature of this water drops to below 59° (dew point).

The recovery of the heat contained in the combustion gases begins as soon as the temperature of the return water is less than that of the burnt gases.

The price of this exchanger is relatively high, which limits the use thereof.

This disadvantage is overcome with this new configuration of the exchanger which allows the boiler of the invention to be provided with an exchanger-condenser, and this without great effect on the cost price of the boiler.

According to other particular embodiments of the present invention, structural modifications may be made concerning the burner(s) and the fins of the exchanger.

The first modification to the burner consists in providing additional air intake orifices in the region of the body of the burner which follows after the zone of the mixer.

The advantage of this improvement resides in the fact that a fairly large part of the combustion air which penetrates into these orifices—whose diameter will be judiciously calculated—is taken from that which passes through the mixer. Now, the main pressure drop of the combustion air circuit is situated precisely in the zone of the mixer. Thus, without changing the total amount of air which is introduced into the burner, and by causing less air to pass through the mixer, the pressure drop of the air flow is reduced, which causes a lesser air pressure in the fore-hearth. It is then possible to use a less powerful fan, which economizes electric energy and reduces the construction price. Furthermore, the air introduced through said orifices creates a turbulence favorable to the air-gas mixture.

The second modification consists in making the manifold independent of the burner ramp, which enables this latter to be easily fitted and refitted without removing the manifold which is integral with the gas inlet.

For this purpose a double-wall manifold will be provided, whose inner wall forms a cylinder which is coaxial with the ramp.

The ramp is slidable with an easy fit inside the above-mentioned cylinder.

The gas arrives into the mixer through orifices disposed in a ring and provided in this inner wall. It will be preferably arranged for these orifices to open above the ramp of the burner so that the gas penetrates freely, otherwise it would be necessary to provide also perforations in the ramp itself.

Additional air intake orifices will be advantageously provided, which form the subject matter of the preceding modification. In this case, the extended inner wall of the manifold and the ramp will comprise facing orifices for the introduction of this additional air.

The above-mentioned modification which may be made to the exchanger consists in modifying the arrangement of the fins of the tubes of this exchanger so that the fins of one tube are staggered in height with respect to those of the adjacent tube, which enables the different tubes forming the exchanger to be brought closer together.

In exchangers where the water tubes are disposed either in rings or in lines, the fins of one tube are all situated at the same level as those of adjacent tubes and the fins of the exchanger which are in the same plane are disposed almost touching. V-shaped baffles must be placed on the outside of the tubes so that the combustion flames affect the maximum area of the fins.

The layout of the fins in accordance with this particular embodiment causes the flames and the hot gases to lick directly a large part of the section of the fins, without need for baffleplates.

Furthermore, this arrangement allows, on the one hand, for the same number of tubes, the volume of the exchanger to be reduced, thus causing a reduction in the dimensions of the boiler and so a reduction in its cost price and, on the other hand, for the same space (same diameter of an exchanger with tubes disposed in a ring), a larger number of tubes to be provided (as a general rule 25% more) which contributes to improving the efficiency of the boiler.

It goes without saying that if a zone is provided for condensation of the water vapor resulting from the combustion, as outlined above, the fins of the section of the exchanger-condenser will have to be disposed in the advantageous way which has just been defined.

DESCRIPTION OF THE DRAWINGS

There will be described in detail hereafter by way of indication and in no wise limiting several embodiments of the boiler in accordance with the present invention with reference to the accompanying drawings in which.

DESCRIPTION OF THE PREFERRED EMBODIMENTS

Figure 1:
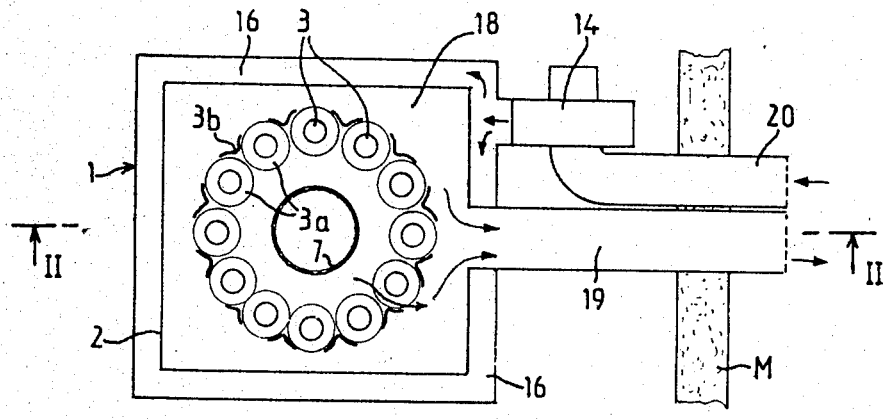
FIG. 1 is a top view with partial horizontal section of a boiler in accordance with the invention.
Figure 2:
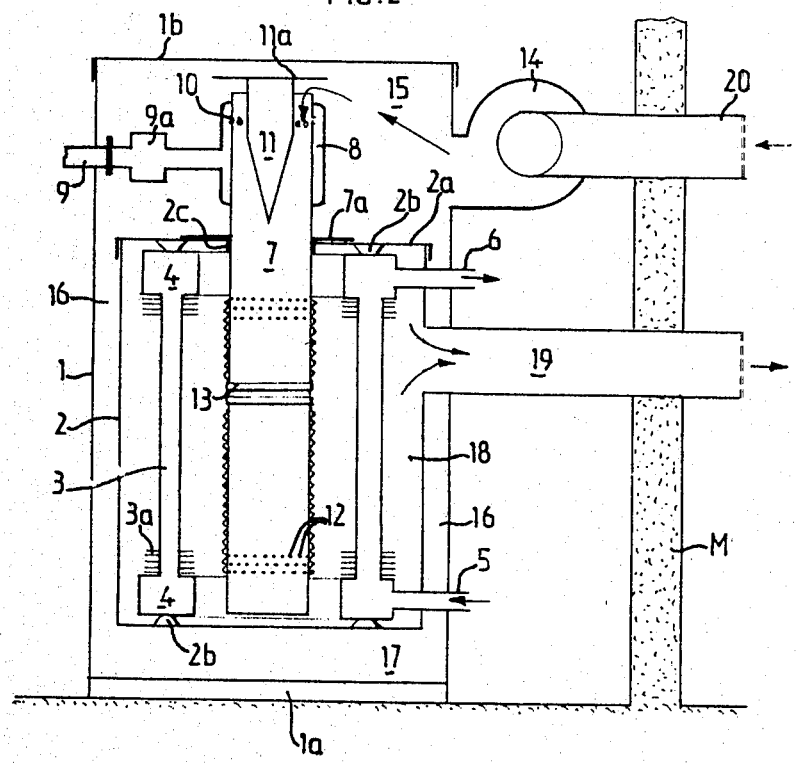
FIG. 2 is a section through II—II of FIG. 1.

In the embodiment shown in FIGS. 1 and 2, the boiler comprises a vertical sealed casing 1, which may be placed on the ground on a base 1*a* and is closed at its upper part by a removable cover 1*b*. The cross-section of casing 1 may have any shape, square for example.

Casing 1 contains a box 2, smaller in cross-section and smaller in height, disposed so that there is provided a free space on all its faces. Box 2 is provided with a removable cover 2*a*.

It contains an exchanger formed of tubes 3, disposed vertically along the generatrices of a cylinder, as shown in FIG. 1, between two annular manifolds 4. The water to be heated enters the lower manifold through a pipe 5 and leaves the upper manifold through a pipe 6. As can be seen in FIG. 2, pipes 5 and 6 pass sealingly through the walls of box 2 and casing 1.

The bottom of box 2 and cover 2*a* are placed in contact with the exchangers through annular bosses 2*b* with which they are provided (FIG. 2). Tubes 3 are provided, over the whole of their length, with fins 3*a* for increasing the heat-exchange surface. Furthermore, vertical V-shaped baffles 3*b* are disposed on the outside of tubes 3, as shown in FIG. 1, for causing the gases to lick said tubes.

Cover 2*a* of box 2 has a circular axial orifice 2*c* through which there is introduced, in the axis of the exchanger, a burner 7 which presents in its upper part, a sealing ring 7*a* which rests on this lid 2*a* (FIG. 2).

At its upper part, outside box 2, the burner comprises a mixer 8, formed from an annular jacket which surrounds the tubular body of the burner.

The gas arrives through a lateral tube 9, which passes sealingly through the wall of casing 1 and in which are mounted, inside casing 1, the regulation and control devices 9*a*.

The gas passes into the body of the burner through a ring of injection holes 10 situated at the upper part of the mixer.

The air inlet section of this latter is regulated by means of a cylindro-conical core 11, provided with an upper collar 11*a* and which is caused to penetrate to a greater or lesser extent into the body of burner 7.

This body extends into box 2 as far as the bottom of the lower manifold. It is closed at its base and pierced over the whole of its portion facing tubes 3 with multiple rings of small holes 12 through which the air and gas mixture leaves. This outlet through multiple small holes prevents flashback of the flame.

So that the fins 3*a* of the exchanger receive the same amount of heat over the whole height of tubes 3 despite the convection movements of the burnt gases in the vertical direction, the perforated portion of the burner is provided with covering rings 13 which are brought together to a greater or lesser extent so as to free the number of holes required. Two rings 13 only are shown in FIG. 2 so as not to complicate the drawing.

The upper part of casing 1 is connected to a fan 14 which pressurizes the fore-hearth 15 formed by said part, as well as the annular space 16 which surrounds box 2 and the lower part 17, situated under this box.

The burnt gases are collected in space 18 where they arrive after passing between tubes 3, 3*a* and they leave box 2 through a lateral pipe 19 which passes sealingly through the wall of casing 1 then wall M.

The fresh air is supplied to fan 14 by a pipe 20 which also passes through wall M.

The boiler which has just been described operates as follows: fan 14 draws fresh air through pipe 20 and pressurizes spaces 15, 16 and 17 of casing 1 which forms a fore-hearth. This air is forced into mixer 8 where it is mixed with the gas leaving the injection holes 10.

After ignition, the mixture burns around burner 7, passes between tubes 3, 3*a*, while circumventing them, because of the presence of baffles 3*b*, reaches space 18 and leaves through pipe 19.

Pipes 19 and 20 open substantially in the same vertical plane and at a small distance from each other, the wind which is possibly exerted on their orifices makes constant the differential inlet and outlet pressures of the air. The result in this case is an overpressure in the fore-hearth, which has no appreciable effect on the pressure differences and so on the flow of combustion air.

Figure 3:
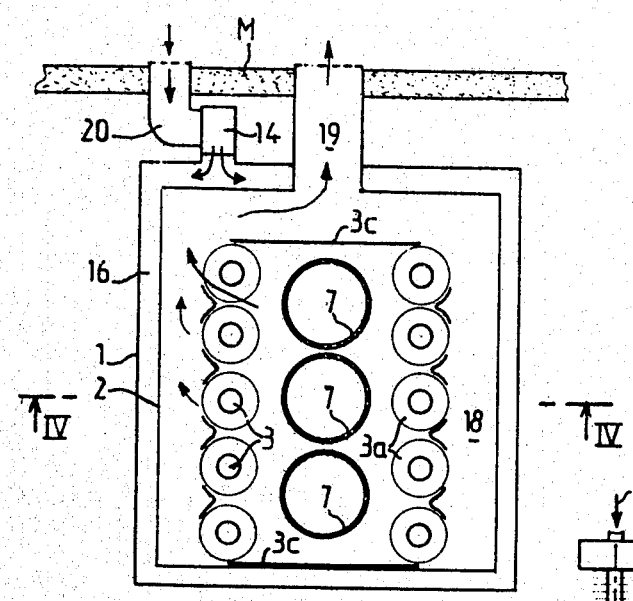
FIG. 3 is a similar view to FIG. 1, but showing a variation.
Figure 4:
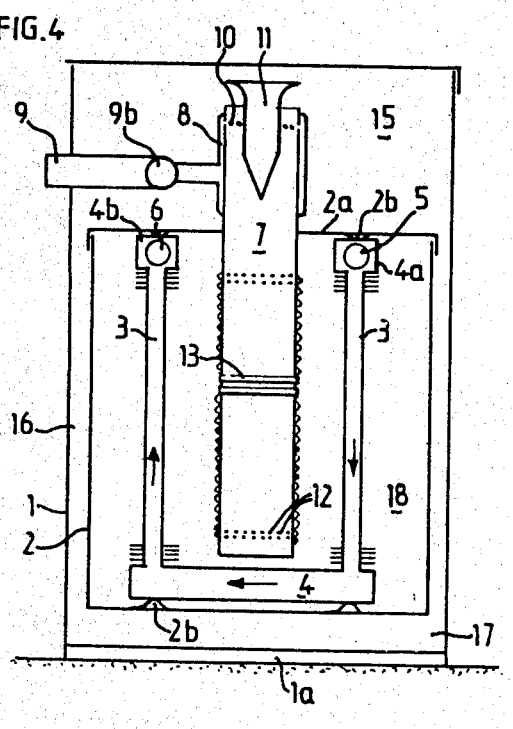
FIG. 4 is a section through IV—IV of FIG. 3.

In the variation of FIGS. 3 and 4, the finned tubes 3, 3*a* of the exchanger are disposed along two parallel lines and vertical screens 3*c* are provided at the ends of these lines, between these latter, so as to force the gases to pass between the tubes.

The upper manifold has two compartments 4*a* and 4*b* which communicate respectively with one and the other of the lines of tubes, water being taken in at 5 in compartment 4*a* and exiting at 6 from compartment 4*b*. The water flows then from top to bottom in the right-hand tubes and from bottom to top in the left-hand tubes, as shown by arrows in FIG. 4. Three burners 7 are disposed vertically and in line between the two lines of tubes 3. They are supplied from pipe 9 by means of a manifold 9*b*.

The operation is the same as that of the previously described embodiment.

Figure 5:
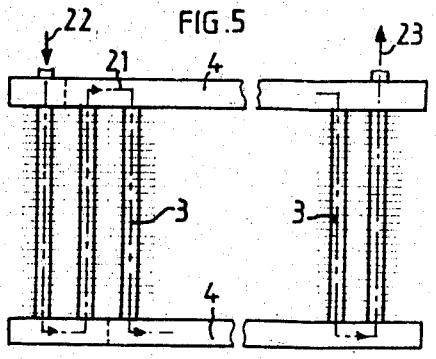
FIG. 5 is a developed schematical view of an exchanger arranged so as to supply hot water for domestic use.

If it is desired to produce hot water, for example for domestic, sanitary or industrial purposes, without being obliged to pass through an external exchanger, all that is required, whatever the variation adopted for the boiler, is to pass a tube 21 through tubes 3 and manifolds 4. The inlet for the water to be distributed is at 22 and the outlet at 23, in FIG. 5.

Tube 21 is preferably made from copper or stainless steel. The heat exchange is very active because of the large contact area and the high speeds of the water on both sides. The volume of the boiler remains the same.

The advantages which the present invention brings are multiple.

The overpressure which reigns constantly in casing 1 about box 2 prevents any leakage of burnt gas from spreading into the boiler room.

The presence of air in spaces 15, 16 and 17 avoids the need to use heat-insulating products on the walls of casing 1. In fact, the air heated in lower spaces 16 and 17 rises in the casing where it mixes, in space 15, with the fresh air blown by the fan. The result is a thermo-siphon flow which, on the one hand, prevents excessive heating up of the air and, on the other hand, ensures reheating of the air which penetrates into mixer 8. The heat thus recovered participates in a better overall efficiency of the boiler. The energy to be produced by the fan is moreover economized. The control and regulation apparatus 9*a* operate well for they are coded by the intake of fresh air into the upper space 15 where they are placed.

The mixture of air and gas may be proportioned stoechiometrically in the mixer(s) 8, which allows a very short flame to be obtained and so an extremely reduced hearth capacity. The central part of the mixer(s) formed by the cylindro-conical core 11 is easily removable and allows easy access to the body of the burner. Now, it is inside this body and on the small holes 12 that dust may collect. After lifting cover 1*b* and core 11, simple brushing causes the dust to fall to the bottom of the burner which has been extended for this purpose downwards under the perforated portion. Thus there is no need to provide a filter in the fresh air intake, which would be more difficult to clean than the burner. Furthermore, abnormal fouling up of the inside of the burner is signaled by the air flow controller which automatically stops the boiler. Removal of the burner presents no difficulty once the cover 1*b* of the casing has been removed.

The vertically positioned exchanger offers advantages: in the embodiment of FIGS. 1 and 2, the intake of water at the bottom and the discharge thereof at the top allow a complete air purge. Furthermore, since water flows through all the tubes at the same temperature, no tension problem occurs due to differences of expansion.

Whatever the embodiment adopted, the installation is very simple since it is sufficient to cause pipes 19 and 20 to pass on the outside, their outer orifice being preferably protected by a grid.

If the advantage of the sealed circuit is not desired or cannot be put into effect, it is sufficient to connect pipe 19 to a chimney, the fan then sucking air into the boiler room.

The fan may be calculated so that an appreciable residual pressure is provided at the outlet for the combustion products. Thus the section of the chimney or the section of the pipes 19 and 20 which connect the boiler to the outside may be considerably reduced when the sealed circuit is used as a whole.

A 200 kW boiler has been constructed in accordance with the invention which measured on the ground $0.50 \times 0.45$ m and had a height of 1.05 m. This volume is about a seventh of that of a conventional gas boiler. The weight is correlatively reduced, the boiler being able to be transported in the rear boot of a light saloon car.

Figure 6:
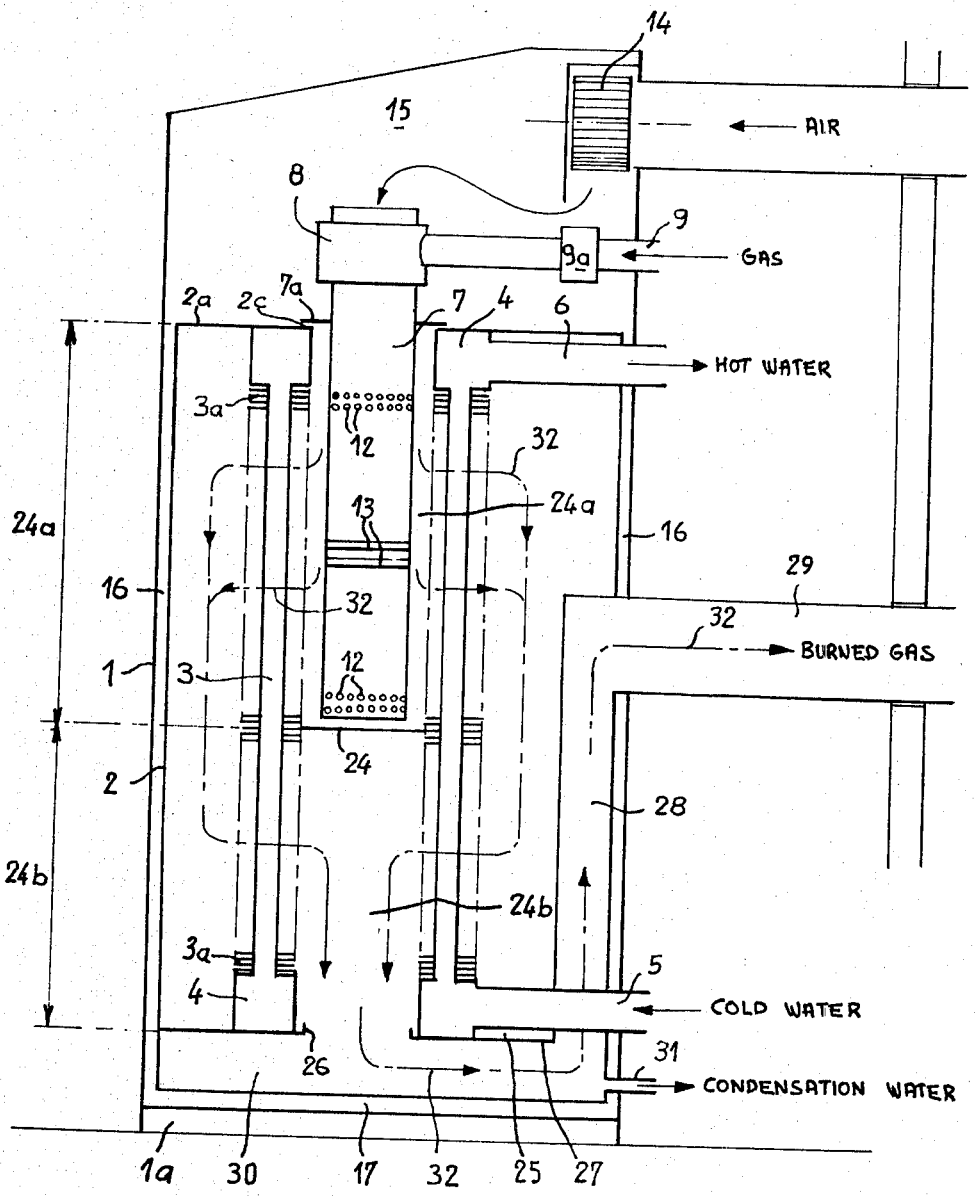
FIG. 6 is a view in vertical section of a boiler fitted with an exchanger-condenser, in accordance with one particularly advantageous embodiment of the invention.

The boiler shown in FIG. 6 conforms to a particular embodiment of the invention. Like the boiler shown in FIG. 1, it comprises a vertical sealed casing 1 which may be placed on the ground on a base 1*a* and which contains a box 2 whose cover 2*a* has a circular axial orifice 2*c* through which is introduced a burner 7 which presents, in its upper part, a sealing collar 7*a* which rests on this cover 2*a*. Burner 7 comprises an air-gas mixer 8, situated outside box 2, into which the gas arrives through a lateral pipe 9 in the path of which are placed the regulating, control and safety apparatus 9*a*. The air is brought by a fan 14, which causes an overpressure in fore-hearth 15, the annular space 16 surrounding box 2 and the lower part 17 situated under this box. The burner 7 is extended inside box 2, substantially over half of its height or more, by a cylindrical ramp pierced with multiple rings of small holes 12 (about 8/10ths of a millimeter in diameter) through which exits the fired air-gas mixture, closure strips 13 also being provided. Box 2 contains an exchanger formed from tubes 3 having fins 3*a*, disposed vertically between two annular manifolds 4, and in a ring about the ramp of burner 7.

In accordance with this particular embodiment of the invention, these tubes 3 extend beyond this ramp.

The water to be heated enters the lower manifold through a pipe 5 and leaves the upper manifold through a pipe 6.

A refractory floor 24 situated below the bottom of burner 7 in the space limited by the tubes 3 to which it is fixed by any appropriate means, separates the inside of the exchanger 3 into two parts, the top part 24*a* forming the exchanger properly speaking and the lower part 24*b* receiving at 5 the return water (cold water) and operating as an exchanger-condenser.

To this end, the combustion gases (comprising water vapor) leaving part 24*a* are fed again laterally into part 24*b*, the water to be heated entering part 24*a* after recovering the condensation heat in part 24*b*, thus improving the efficiency of the boiler.

The lower manifold 4 is spaced apart from the bottom of box 2. It rests on a plate 25 having a central opening 26 and a side opening 27 opening into a vertical pipe 28 conveying the burnt gases to the outside and terminating for this purpose in an outlet bend 29 substantially halfway up box 2.

Plate 25 and the bottom of box 2 define a sealed tray 30 having a lateral pipe 31 for discharging the condensation water.

The path followed by the burnt gases, including water vapor, is then the arrowed path 32. The condensation water is collected at 31 and may be recovered as distilled water.

Figure 7:
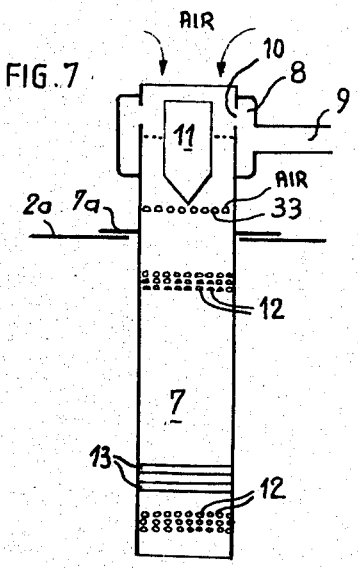
FIGS. 7 and 8 each show a view in vertical section of a variation of a burner fitted to the boiler of the invention.

FIG. 7 shows a burner 7 with the annular jacket of mixer 8 and the cylindro-conical core 11 for regulating the air intake section into the mixer, this burner 7 having, in this variation, the particular characteristic of having a series of air intake holes 33 (for example a ring of holes) situated between collar 7*a* and mixing zone 8. Improved efficiency of the burner has been noted for the reasons which were outlined above in the introduction.

Figure 8:
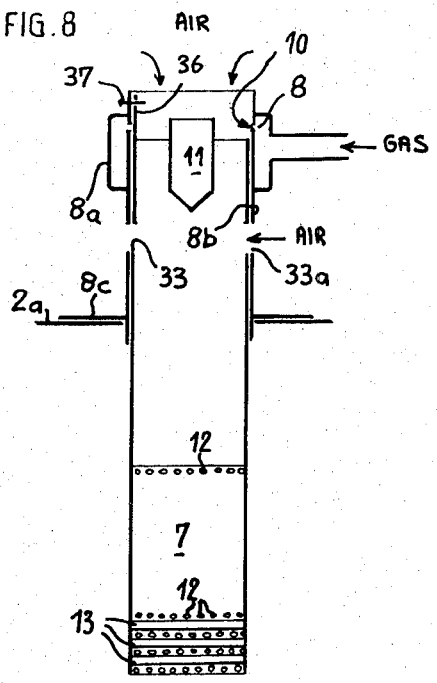

FIG. 8 illustrates another constructional variation of the burner in which the annular jacket 8 which forms the gas manifold is double-walled, the external wall 8*a* not having undergone any modification and the internal wall 8*b* forming a cylinder which is coaxial with ramp 7 and which is extended moreover as far as the box 2 of the boiler where it carries a collar 8*c* which rests on cover 2*a* of box 2.

The internal wall 8*b* comprises a ring of holes 10 for the injection of the gas, whose outlets are situated a little above the top of ramp 7.

This latter fits with a sliding fit in tube 8*b*; it carries at its upper part a lug 36 which may be formed by an extension of its wall and which is perforated to allow a positioning pin 37 to be passed therethrough, which also passes through wall 8*b* of the manifold.

During maintenance inspection, the operator removes pin 37 and ramp 7 so as to check it and clean it. It may be easily put back in place since all that is required is the reverse operation.

Gas injection holes 10 may also be checked without it being necessary here again to disconnect the gas inlet.

It will also be noted that additional air inlet orifices 33 may be envisaged as a variation in accordance with FIG. 7, orifices 33*a* situated opposite orifices 33 having to be provided in wall 8*b*.

Figure 9:
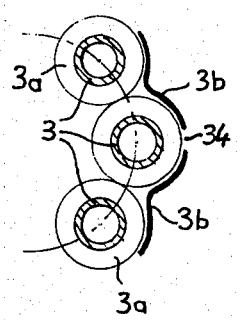
FIG. 9 is a view partly in horizontal section of the exchanger of the boiler according to FIG. 1
Figure 10:
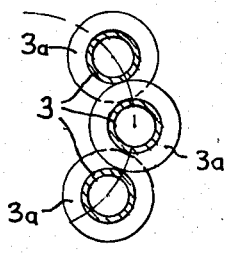
FIG. 10 is a view similar to the preceding one, showing an interesting variation of the arrangement relative to the fins.

Furthermore, insofar as the exchanger of the boiler of the invention is concerned, whose tubes 3 are disposed either in a ring around a single burner (FIG. 1), or in lines (FIG. 3), its fins 3*a* will be situated in the same horizontal plane practically touching, as can be seen in detail in FIG. 9. In this case, so that the combustion flames affect the maximum area of fins 3*a*, baffles 3*b* must be placed to force the flames or very hot gases to pass round the tubes and their fins 3*a* before leaving through slits 34. To avoid this drawback, tubes 3 may be disposed as shown in FIG. 10, the fins 3*a* of one tube being staggered in height with respect to the fins 3*a* of the adjacent tubes 3, and the outer edge of each fin 3*a* practically touching the adjacent water tubes 3. This disposition forces the flames and hot gases to lick a large part of the section of the fins, which enables baffles 3*b* to be done away with without any disadvantage.

It will moreover be readily understood that the embodiments of the present invention which have just been described have been given by way of indication and are in no wise limiting and the modifications may be made thereto without departing from the scope and spirit of the present invention.

What is claimed is:

1. A gas boiler comprising an inner casing having a removable cover, an exchanger disposed within said inner casing and comprising finned tubes disposed vertically and connected to upper and lower manifolds, said inner casing having a top part and a burner disposed vertically through said top part with a portion of said burner extending into the space defined by said finned tubes, said burner having a portion retained by a sealing collar above said top part of said inner casing, said burner comprising a tubular body open at its top and whose section situated interiorly of said inner casing opposite said finned tubes is provided with multiple holes and is closed at its lower end below said multiple holes; a vertically disposed exterior casing surrounding said inner casing and said top part of said burner, said exterior casing having at its upper part a removable cover, said exterior casing forming a sealed fore-hearth comprising a space provided between said inner casing and the interior of said exterior casing; a gas intake means passing through the upper part of said exterior casing and being connected to said top part of said burner, said gas intake means having safety and control apparatus mounted thereon; a combustion air intake means connected to said upper part of said casing, a collector for discharging burnt gases connected to said inner casing and passing through said exterior casing, and means in said combustion air intake means for injecting air under pressure into said space from where the air under pressure penetrates into said burner through the open top thereof, said burner comprising at its top part a mixer for the gas and the air penetrating into said burner, said mixer comprising an annular jacket surrounding the tubular body of said burner and to which is connected said gas intake, a ring of gas injection holes provided in said tubular body of the burner opposite said annular jacket and a core for regulating the air intake section of said burner, slidably mounted for this purpose in the top part of said burner and which is movable, thus allowing easy in situ cleaning of the inside of the burner.

2. A boiler as claimed in claim 1, wherein closure rings are provided on said section of the tubular body of said burner, which is pierced with multiple holes, so that said finned tubes of said exchanger receive the same amount of heat over the whole of their height, despite the convection movements of the burnt gases in the vertical direction.

3. A boiler as claimed in claims 1 or 2, wherein said safety and control apparatus mounted in the gas intake means are placed in the upper region of said fore-hearth, where the fresh combustion air arrives.

4. A boiler as claimed in claims 1 or 2, with a sealed combustion circuit wherein said means for injecting the combustion air under pressure is a fan whose air intake height originates outside and where the discharge pipe for the burnt gas extends exteriorly of the exterior casing, said fan feeding directly into said space between the exterior casing and said inner casing at a point located above said inner casing and pressurizing said sealed fore-hearth.

5. A boiler as claimed in claim 4 wherein said fan provides a residual output pressure of the burnt gases which allows the section of said combustion air intake means and of said discharge manifold for the burnt gases to be reduced.

6. A boiler as claimed in claims 1 or 2, wherein the tubular body of said burner has, in its top part situated above said box, a series of additional air intake orifices in the region which follows said mixer.

7. A boiler as claimed in claims 1 or 2, wherein the fins of a tube of said exchanger are staggered in height with respect to the fins of adjacent tubes of said exchanger, the outer edge of each fin almost touching said adjacent tubes.

8. A boiler as claimed in claims 1 or 2, wherein said exchanger comprises a hot water supply circuit for sanitary or industrial purposes, in the form of piping passing through said tubes and said manifolds, said piping being connected to a water input and to a water output.

9. A boiler as claimed in claim 1 or 2, with a sealed combustion circuit, wherein said safety and control apparatus mounted in said gas intake means are placed in the upper region of said fore-hearth, where the fresh combustion air arrives; said means for injecting the combustion air under pressure is a fan whose air intake pipe originates outside in the vicinity of the place where said discharge pipe for the burnt gases has outside its outlet, said fan feeding directly into said sealed casing above said box and pressurizing said sealed fore-hearth and providing a residual output pressure of the burnt gases which allows the section of the combustion air intake and of said burnt gas discharge pipe or that of a possible burnt gas discharge chimney to be reduced; the tubular body of said burner has in its top part situated above said box a series of additional air intake orifices in the region which follows said mixer; and the fins of a tube of said exchanger are staggered in height with respect to the fins of the adjacent tubes of said exchanger, the outer edge of each fin almost touching said adjacent tubes.

10. A boiler as claimed in claim 9, wherein said exchanger comprises a hot water supply circuit for sanitary or industrial purposes, in the form of piping passing through said tubes and said manifolds, said piping being connected to a water input and a water output.

* * * * *